United States Patent [19]

Inoue et al.

[11] 4,354,372

[45] Oct. 19, 1982

[54] METHOD AND APPARATUS FOR COLD ROLL FORMING METAL STRIP

[75] Inventors: Takesi Inoue, Yasugi; Kuniaki Okada, Matsue, both of Japan

[73] Assignee: Hitachi Metals, Ltd., Tokyo, Japan

[21] Appl. No.: 17,895

[22] Filed: Mar. 6, 1979

[30] Foreign Application Priority Data

Mar. 8, 1978 [JP] Japan ..... 53-26386

[51] Int. Cl.[3] ..... B21B 15/00; B21D 5/14

[52] U.S. Cl. ..... 72/177

[58] Field of Search ..... 72/177, 181, 168

[56] References Cited

U.S. PATENT DOCUMENTS

| | | | |
|---|---|---|---|
| 1,266,545 | 5/1918 | Anderson | 72/181 X |
| 2,150,731 | 3/1939 | Smith | 72/181 |
| 2,339,355 | 1/1944 | Rutten | 72/129 |
| 3,491,569 | 1/1970 | Sabirov | 72/181 X |
| 3,529,461 | 9/1970 | Knudson | 72/181 |
| 3,570,293 | 3/1971 | Blaski | 72/181 X |
| 3,610,011 | 10/1971 | Valentine | 72/177 |
| 4,048,827 | 9/1977 | Lipp | 72/168 X |
| 4,080,815 | 3/1978 | Foster | 72/177 X |

*Primary Examiner*—Ervin M. Combs
*Attorney, Agent, or Firm*—Craig & Antonelli

[57] ABSTRACT

A method for producing, from metal strip, a cold roll formed shape strip, curved longitudinally a predetermined amount and having its edge portions on the concave side of the curvature and its web on the convex side thereof to inhibit elongation deformation of portions of the metal strip which constitute the edge portions of the shape strip. The method includes a first step of subjecting the metal strip to roll forming to effect shaping thereof, while advancing the metal strip, under conditions of changing gradually the height of the point of contact between metal strip to be formed and rolls of each cold forming roll stand, and a second step of subjecting the roll formed shape strip to roll forming to curve the same longitudinally thereof to give thereto a predetermined radius of curvature, under conditions of changing gradually the height of the point of contact between roll formed shape strip and rolls of each cold forming roll stand in the reverse direction to the first step, while simultaneously effecting roll forming from multiple directions at least as part of the second step.

17 Claims, 37 Drawing Figures

2

3
1
3
1

R

H
4
5
6

NO. 1

NO. 2

NO. 3

NO. 4

NO. 5

NO. 6

METHOD AND APPARATUS FOR COLD ROLL FORMING METAL STRIP

BACKGROUND OF THE INVENTION

This invention relates to a method of cold roll forming using a plurality of cold forming roll stands for producing cold roll formed shape strip having a predetermined curvature longitudinally thereof, and more particularly to a method of cold roll forming for producing a cold roll formed shape strip of special cross sectional shape curved longitudinally with a predetermined curvature and having its edge portions on the concave side of the curvature and its web on the convex side thereof.

In subjecting metal strip to cold roll forming to gradually give a predetermined shape to the metal strip by passing it through a plurality of cold forming roll stands, it has hitherto been usual practice to use a straightener to straighten the metal strip longitudinally. However, it has hitherto been customary to utilize press forming in producing curved products having a predetermined curvature longitudinally thereof. Press forming has been low in productivity, very low in efficiency in forming products of large length, and expensive. Also, in producing curved products by press forming, there has been raised the problem of developing galling on the surface of the product and thereby reducing its quality. Therefore, it has hitherto been earnestly desired to establish a method of cold roll forming capable of producing, with a high degree of efficiency, roll formed products, such as bumpers for automotive vehicles, which are produced on mass production basis. Lately, some of those skilled in the art made an attempt to form bumpers by cold roll forming as bumpers for automotive vehicles. In such a system fourteen stands of cold forming roll stands were used which have the same height of the point of contact between the metal strip to be roll formed. Rolls of each cold forming roll stand carried out longitudinally straight shaping, then curving was carried out longitudinally by four stands of cold forming roll stands. The radius of curvature of the roll formed product was fourteen meters. The twist of the roll formed product was reformed and the roll formed product was cut to a predetermined length.

However, a problem has been encountered with regard to buckling of rise portions of the roll formed product, therefore, straight shaping was carried out similarly by a previous fourteen stands of cold forming roll stands, then curving was carried out longitudinally by a combination of shoes and bending rolls, and then twist of the product was reformed and the radius of the curvature of the product was fourteen meters. Thus, a solution has been achieved with regard to preventing buckling to some extent, but in the curved product produced as explained above, a problem has been raised that galling occurred in bending corner portions of sectional shape of the curved product and galling occurred to the curved product by roll forming and shoe forming, further, the radius of the curvature was large, that is, fourteen meters.

As a result, it has not been established yet that the method of cold roll forming can form efficiently in a stable manner, cold roll formed strip of high quality which is free from surface defect, edge wave, buckling and deformation and has a small longitudinal curvature of the product. As mentioned above, difficulties have been encountered in producing, by cold roll forming, shape strip of light weight having a special cross sectional shape with lips in such a manner that the shape strip has a longitudinal predetermined curvature. In particular, a difficulty has been experienced in curving metal strip longitudinally to give a predetermined curvature thereto in such a manner that the edge portions of the product are on the concave side of the curvature and the web of the product is on the convex side of the curvature.

More specifically, in producing shape strip by using ordinary upper and lower rolls, forming of shape strip starts with the rise portions of the cross sectional shape and is successively effected until the lips are shaped. As a result, the lips are subjected to extensive elongation and the roll formed shape strip has a longitudinal curvature with the lips on the convex side of the curvature. Therefore, it has been necessary to take some measures to effect curving of the shape strip in a direction opposite to the aforesaid direction. When metal strip of small thickness and large width is cold roll formed into shape strip of light weight or a deck plate, a problem has been encountered with regard to irregular elongation and buckling of edge portions. This problem has been serious when metal strip is formed of stainless steel or other material of high tendency to spring back or when the metal strip has a large width and a small thickness and the shape to be given to the strip is complex. Generally, when a product has a circular cross sectional shape, such as a pipe, it has been believed impossible to obtain such a product by cold roll forming if the ratio T/D (wherein D is the diameter of the cross section of shaped product and T is the thickness thereof) is below 0.01. Thus, difficulties are experienced when roll formed product has a high rise relative to its width, is small in thickness, and is complex in cross sectional shape. Imbalance between the tensile and compressive deformation stresses acting on the side edge portions of strip and the deformation stresses acting on the widthwise central bottom portion of the strip would cause buckling of the edge portions of the formed product and result in forcible shaping of the strip. When this is the case, seizing and galling or deforming would occur in the interface between the rolls and rolled product, Thus, it would be impossible to produce a desired roll formed product. To inhibit the occurrence of buckling or elongation of the edge portions of strip, so-called downhill cold roll forming may be used in which the height of the point of contact between strip to be roll formed and the rolls of each cold forming roll stand is reduced from one stand to another as roll forming progresses, so as to suppress elongation of the edge portions and achieve balance in deformation of the roll formed product. There is also available so-called uphill cold roll forming in which the height of the point of contact between strip to be roll formed and the rolls of each cold forming roll stand is increased from one stand to another as the operation progresses, so as to effect roll forming by gradually imparting elongation deformation to marginal portions of the strip.

SUMMARY OF THE INVENTION

This invention has as its object the provision of a method of cold roll forming, developed as a result of research into various problems experienced in curving a cold roll formed product in such a manner that the cold roll formed product has a predetermined longitudinal radius of curvature with its edge portions on the concave side of the curvature and its web on the convex side thereof, the method being capable of producing efficiently and stably cold roll formed shape strip of high quality which is free from surface defects, edge waves, buckling and deformation and has a small curve in the edge portions longitudinally thereof.

The aforementioned object is accomplished by using downhill roll forming and uphill roll forming in suitable combination and utilizing roll forming ability increasing means with a cold forming roll apparatus, in an effort to enable a product to be produced by cold roll forming which has hitherto been difficult to produce by this method.

According to the invention, there is provided a method of cold roll forming comprising a first step of subjecting metal strip to roll forming together with changing the height of the point of contact between the metal strip and rolls of each cold forming roll stand to effect shaping thereof so as to inhibit elongation deformation of marginal portions of the metal strip which constitute edge portions of a roll formed product, and a second step of subjecting the roll formed product to roll forming to curve the roll formed product longitudinally thereof in a predetermined amount of curvature in such a manner that the roll formed product has its edge portions on the concave side of the curvature and its web on the convex side thereof, under together with changing gradually the height of the point of contact between roll formed shape strip and rolls of each cold forming roll stand in the reverse direction to the first step, while simultaneously roll forming the product from multiple directions at least as part of the second step. Particularly, it is desirable to combine the imparting of elongation deformation to portions of the metal strip which constitute the web of the roll formed shape strip with the carrying out of simultaneously roll forming from multiple directions as part of the first step. In the present invention, the following features can be used in suitable combination in order to further increase the roll forming ability, to inhibit the development of edge waves and buckling with increased effectiveness, and to reduce the curvature of the edge portions formed longitudinally of the product. The aforesaid features include reducing the spacing between the cold forming roll stands of the roll apparatus in effecting cold roll forming, using a plurality of units of idle rolls arranged between the adjacent cold forming roll stands in such a manner that rolls of each unit are in longitudinally spaced juxtaposed relation for supporting therebetween one of two edge portions of metal strip at opposite surfaces thereof when the metal strip is passed between the rolls of the stands, and disposing an extension of the line connecting the center axes of the confronting roll shafts to substantially pass through the center of the curvature of the roll formed product, so that shaping force is directed toward the center of the curvature of the roll formed product and the product may be formed by cold roll forming.

BRIEF DESCRIPTION OF THE DRAWINGS

FIGS. 4A to 4F are schematic sectional views of rolled products in which the invention can have application;

DETAILED DESCRIPTION OF THE PREFERRED EMBODIMENTS

Figures 1, 2, 3A, 3B:
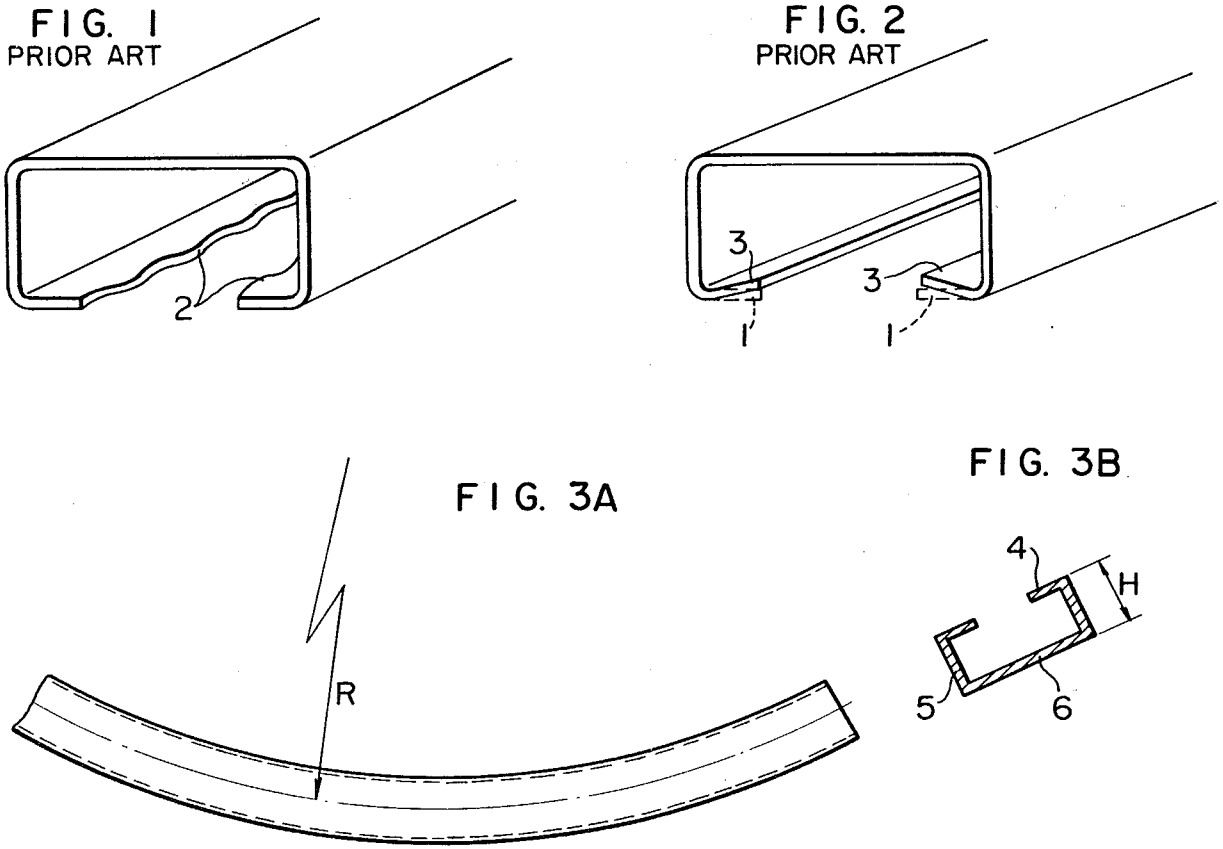
FIG. 1 PRIOR ART
FIG. 2 PRIOR ART
FIGS. 1 and 2 are perspective views of rolled products produced by a method of the prior art, showing their defects.
FIGS. 3A and 3B are a side view and a sectional view respectively of a rolled product curved longitudinally thereof in a predetermined amount of curvature.

FIGS. 1 and 2 show roll formed products wherein their edges have waves at 2 due to buckling and elongation, or part of the section of the product is deformed and bent inwardly at 3, as compared with a predetermined shape 1.

In the present invention, shape strip is not limited to channel shape strip of light weight having lips as shown in FIG. 3B but includes various types of shape strip, such as those shown in FIGS. 4A to 4F, in which a bend is formed in a flange 5 or a web 6 of the channel shape strip of FIG. 3B, or a groove a, U-bends b or bends c are formed in the channel shape strip. It is to be understood that the shape strip produced by the method according to the invention is not limited to those shown in FIGS. 3B and 4A to 4F, and that there are many modifications of shape metal that can be produced by the method according to the invention.

In the present invention, what is referred to as a predetermined curvature formed longitudinally of a roll formed product in such a manner that the product has its edge portions on the concave side of the curvature and its web on the convex side thereof means that, as shown in FIG. 3A, the product is longitudinally curved and has a predetermined radius of curvature in such a manner that its lips are on the side of the center of the concave side of curvature and its web is on the convex side (outer side of the radius of curvature). In FIGS. 3A and 3B, the roll formed product shown therein has lips. However, when the roll formed product has no lips, the definition also encompasses a longitudinal curvature formed in the product in such a manner that it is of the same shape as that shown in FIG. 3 and the edge portions of the product are on the concave side of the curvature and the web of the product is on the convex side of the curvature.

Embodiments of the invention will be described be referring to FIGS. 3A, 3B and 5 to 16C.

Figure 5:
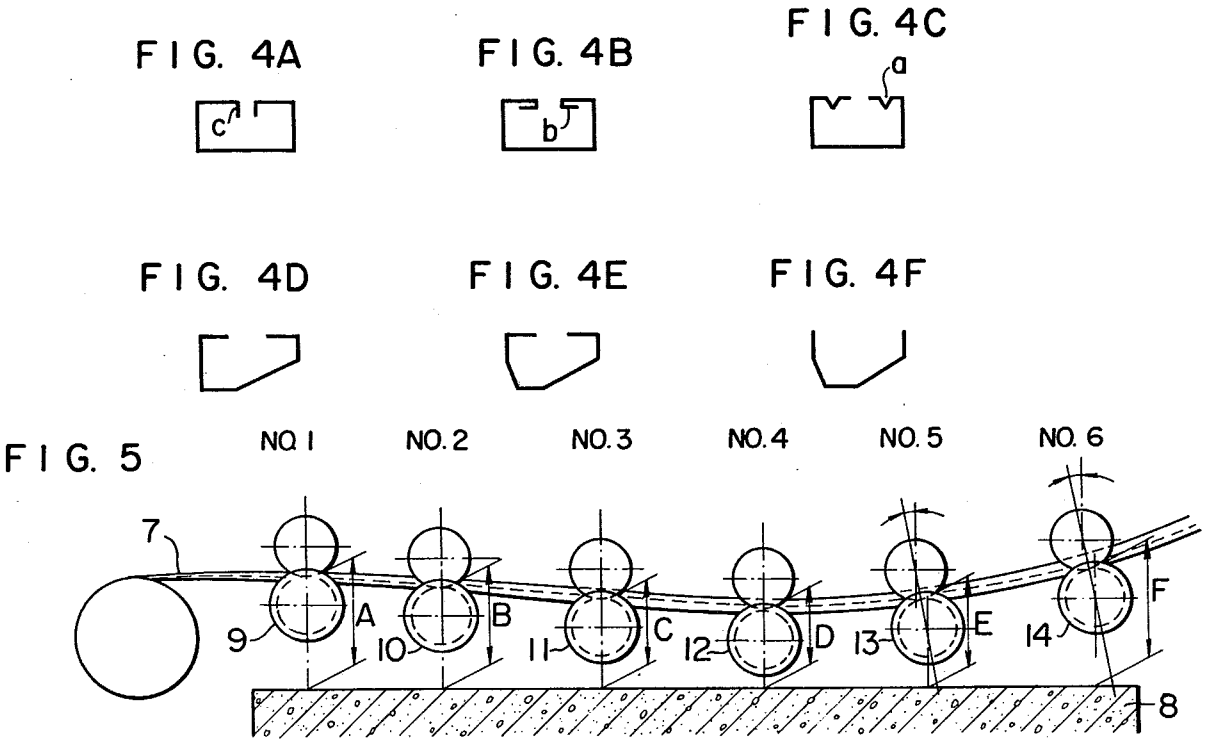
FIG. 5 is a front view of a rolling apparatus suitable for carrying into practice one embodiment of the method according to the invention.
Figure 6A:
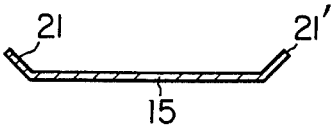
FIGS. 6A to 6F show, in section, various shapes which are imparted to metal strip by the method according to the invention before a final desired shape is imparted to a rolled product.
Figure 6B:
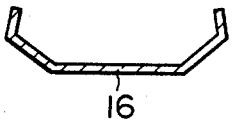
Figure 6C:
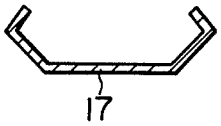
Figure 6D:
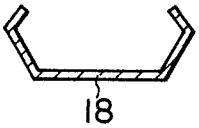
Figure 6E:
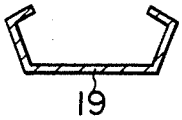
Figure 6F:
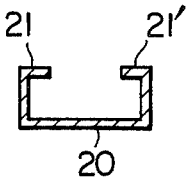

FIGS. 3A and 3B show a cold roll formed product or channel steel of light weight having lips which is curved longitudinally and has a predetermined radius of curvature R. FIG. 5 schematically shows cold forming roll stands for effecting cold roll forming of metal strip, in which shaping rolls are successively mounted in stands No. 1 to No. 6 for effecting roll forming. FIGS. 6A to 6F show, in section, various shapes which are imparted to the metal strip before a final desired shape is imparted to the product. In FIG. 5, power is supplied from a drive built-in a cold forming roll apparatus to various roll stands to form roll the metal strip 7 successively, starting with a roll stand No. 1 and ending with a roll stand No. 6 in which a desired final shape is imparted to the product. In the aforesaid method of cold roll forming, the metal strip 7 is subjected to the first step of downhill roll forming at stands No. 1 to No. 4 by successively reducing the spacings A, B, C and D between lower rolls 9, 10, 11 and 12 and a bed 8 of the roll apparatus (the bed is generally planar, but when the bed is stepped between the stands the reference surface is referred to as a bed 8). The metal strip 7 is subjected to the second step of uphill roll forming at stands No. 5 and No. 6 by successively increasing spacings E and F between lower rolls 13 and 14 and the bed, so as to continuously produce a product which is curved longitudinally inwardly with respect to lips 4 with the predetermined radius of curvature R shown in FIG. 3A. In the method according to the invention, a product of high quality can be obtained if shaping of the lips and flanges is substantially completed in the first step and slight shaping of the lips and curving of the product in the longitudinal direction are effected in the second step. On the other hand in the aforementioned embodiment, when no downhill roll forming is carried out, or when the spacings A, B, C and D are equal to one another, edges 21 and 21' of the metal strip shown in FIGS. 6A to 6F will rise to a higher level as roll forming progresses, with a result that residual plastic elongation strain of high order will be produced in the deformed edges. If roll forming is continued in this condition, the product produced will be curved in a direction opposite to the direction in which the product shown in FIG. 3A is curved. Thus it will be impossible to produce a roll formed product of the desired shape which is curved such that the lips 4 are on the concave side of the curvature.

The method of cold roll forming according to the invention makes it possible to produce cold roll formed products of special cross sectional shapes, curved longitudinally with a predetermined amount of curvature in such a manner that their edge portions are on the concave side of the curvature and their web is on the convex side thereof, which have hitherto been difficult to produce, with a high degree of efficiency and in a stable manner by preventing buckling and deformation and reducing the curvature of the edge portions longitudinally thereof. In order that the method may be able to produce a cold roll formed product of high quality, it is essential that the method include the steps of subjecting the metal strip to roll forming to effect shaping thereof, while advancing the metal strip, and one part of curving is carried out simultaneously to roll formed semi-product, together with changing gradually the height of the point of contact between metal strip to be roll formed and the rolls of each cold forming roll stand, to form its sectional shape by preventing elongation deformation of marginal portions of the metal strip which constitute the edge portions of the roll formed shaped strip, and subjecting the metal strip to roll forming the same longitudinally thereof with a predetermined curvature for curving the product longitudinally thereof, and shaping of the sectional shape of the roll formed product is controlled simultaneously, together with changing gradually the height of the point of contact between roll formed shape steel and the rolls of each cold forming roll stand in the reverse direction to the first step, while simultaneously shaping the product from multiple directions at least as part of the curving step. By this arrangement, buckling and deformation of the product can be avoided.

Further, according to the present invention, as mentioned later, the direction of the roll shafts, the forming state of the product and the like have nothing to do with the essentials of the invention, and it is effective that the height of the point of contact between metal strip to be roll formed and the rolls of each cold forming roll stand be gradually changed in the first step before the operation starts so as to inhibit elongation deformation of portions of the metal strip which constitute the edge portion of the roll formed product, and the height of the point of contact between roll formed shape strip and the rolls of each cold forming roll stand is gradually changed in the reverse direction to the first step before the operation starts so as to curve the curvature of the roll formed product, and shaping of the roll formed shape strip be carried out from multiple directions as part of the second step. In the case of the forming state of the roll formed product as shown in FIGS. 3A and 3B the first step becomes the downhill roll forming and the second step becomes the uphill roll forming as shown in FIG. 5, in case of reversible forming state (rotation of 180 degree of the product) of the roll formed product as not shown in FIGS. 3A and 3B (in case of rotation of 180 degree of the direction of roll shafts), the first step becomes the uphill roll forming and the second step becomes the downhill roll forming. A technique of forming simultaneously from multiple directions is preferable to forming simultaneously from both vertical and horizontal directions.

Also, by imparting elongation deformation at least to a portion of the metal strip which constitutes the web of the product, it is possible to more effectively prevent buckling of the product when the product is curved in the second step. If shaping rolls of one direction or horizontal shaping rolls, for example, are of a construction wherein the rolls rotate independently while in contact with the roll formed product as subsequently to be described when the aforesaid simultaneous roll forming is effected from both vertical and horizontal directions, it is possible to avoid the occurrence of wear of the rolls and seizing of the interface between the rolls and product, thereby eliminating galling in the product. The effect achieved is increased if the simultaneous roll forming is effected from both vertical and horizontal directions at least as part of the first step of subjecting the strip to roll forming to shape the section of the product.

In order to impart elongation deformation at least to a portion of the strip which constitutes a web of the product before the second step of curving the product longitudinally thereof is carried out, it is necessary only to urge a pair of confronting rolls together under high pressure, together with changing gradually the height of the point of contact between roll formed shape strip and the rolls of each cold forming roll stand. The pair of rolls used for shaping the portion of the strip which constitute the web of the product may be concave rolls, convex rolls and flat rolls arranged in suitable combination, and local rolling or heating, such as high frequency heating, may be used to impart elongation deformation.

Figure 7A:
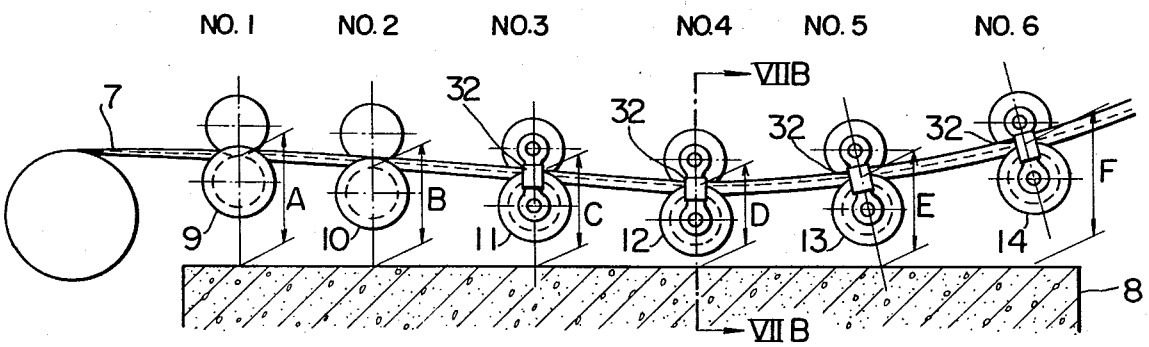
FIG. 7A is a schematic front view of a cold forming roll apparatus capable of effecting roll forming simultaneously both vertically and horizontally according to the method of the invention.
Figure 7B:
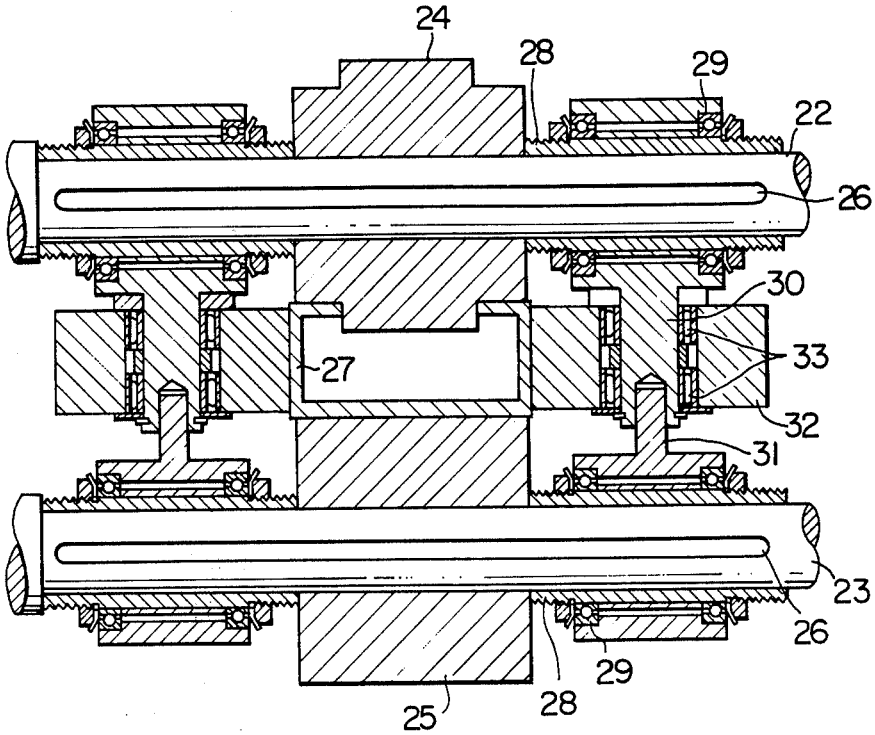
FIG. 7B is a sectional view taken along the line 7B—7B in FIG. 7A.

FIGS. 7A and 7B show one form of means for effecting simultaneous roll forming from multiple directions suitable for use as part of the aforesaid first and second step (cold roll forming effected by the cold forming roll apparatus shown in FIG. 5). FIG. 7A is a schematic front view of a cold forming roll apparatus including six roll stands, wherein rolling stands No. 3 to No. 6 are each provided with a vertical idle roll mounted on a vertical shaft supported at either end of upper and lower horizontal shafts for simultaneously effecting roll forming of the strip both vertically and horizontally. FIG. 7B is a sectional view taken along the line 7B—7B in FIG. 7A. In FIGS. 7A and 7B, an upper horizontal shaft 22 and a lower horizontal shaft 23 have mounted in their central portions a shaping roll 24 and a shaping roll 25 respectively which are secured thereto through keys 26. The roll forming force exerted by the shaping rolls 24 and 25 acts vertically on a metal strip 27 to effect predetermined shaping. A collar 28 secured to either end portion of the upper horizontal shaft 22 through the key 26 has mounted thereon through a bearing 29 a vertical shaft 30, and a collar 28 secured to either end portion of the lower horizontal shaft 23 through the key 26 has loosely mounted thereon through a bearing 29 a projection 31, for positioning a vertical idle roll 32 to be mounted on the vertical shaft 30. That is, the vertical shaft 30 mounted on either end portion of the upper horizontal shaft 22 and formed at its end with a hole has inserted in the hole the projection 31 mounted on the lower horizontal shaft 23, and the vertical idle shaft 32 is mounted on the vertical shaft 30 through needle bearings 33, so that the vertical idle rolls 32 can effect roll forming horizontally.

Figure 8:
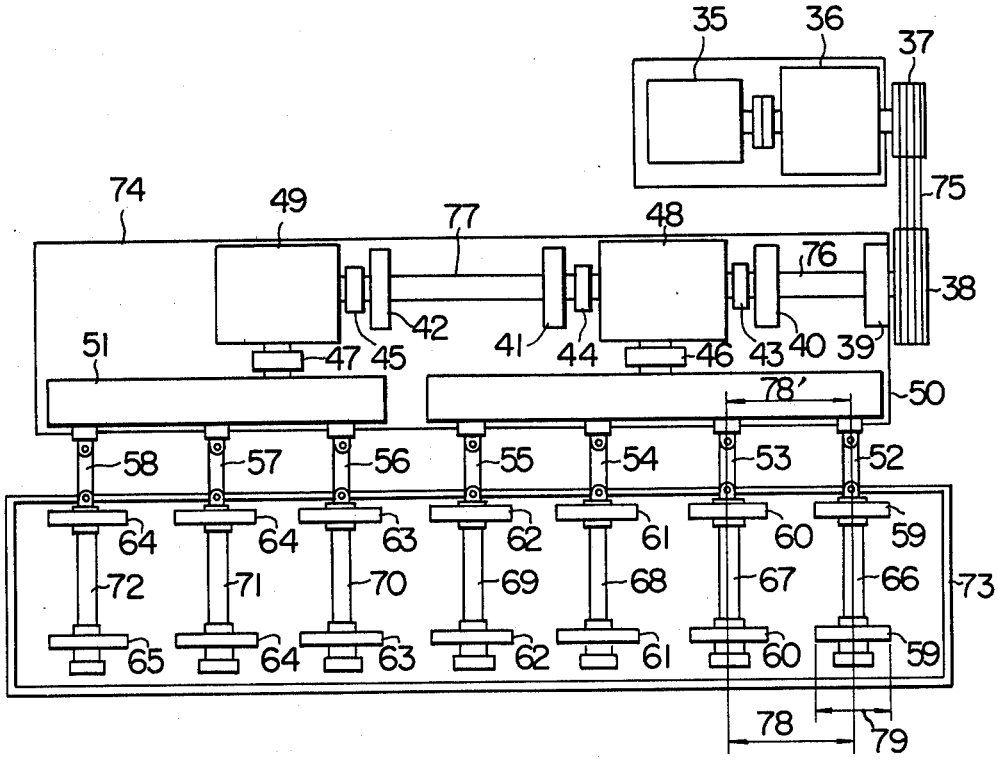
FIGS. 8 and 9 are plan views of cold forming roll apparatus having a reduced spacing between the adjacent two stands according to the method of the invention.
Figure 9:
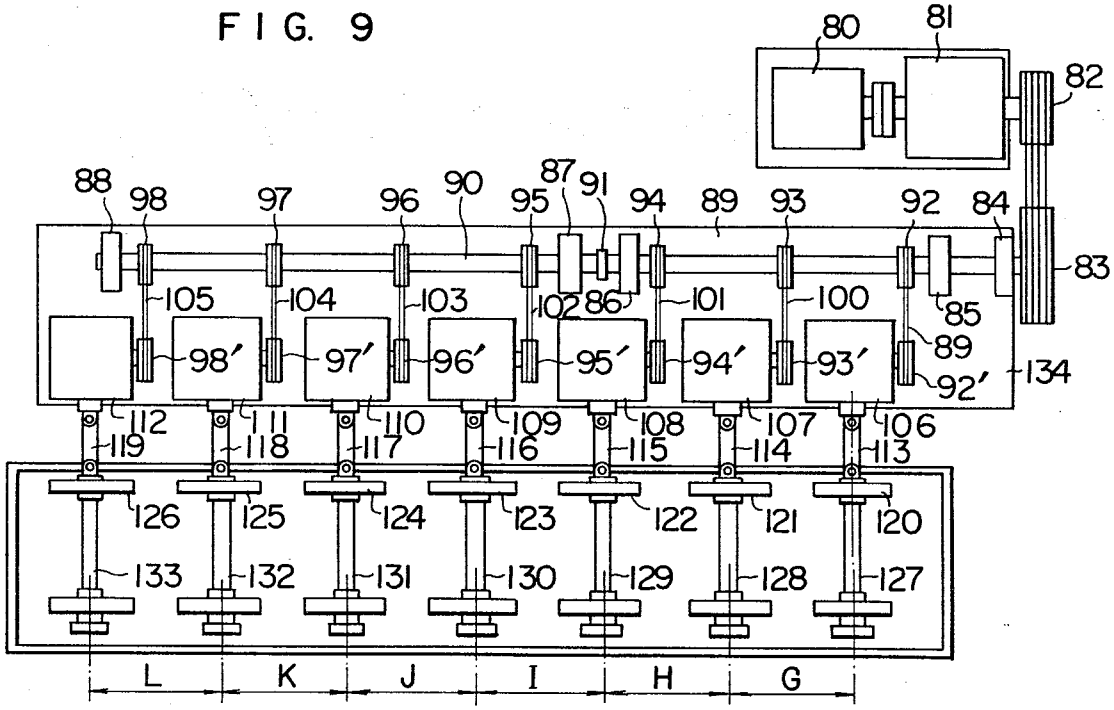

In the present invention, the spacing between the cold forming roll stands is reduced in the first step and the second step without reducing the roll forming ability of the apparatus. By this arrangement, edge waves and buckling of the product can be prevented and spring back thereof can be minimized, thereby enabling the curving of the edge portions of the product longitudinally thereof to be reduced. FIGS. 8 and 9 show different forms of cold forming roll apparatus wherein the spacing between the roll stands can be reduced without reducing the cold roll forming ability of the apparatus. FIG. 8 is a schematic plan view of the apparatus in which intermediate gearings directly connected to worm speed reducing devices are interposed between a drive of the cold forming roll apparatus and the stands, so that drive is transmitted through shaft couplings to the roll shafts. In FIG. 8, 35 designates an electric motor; 36, a speed reducing device; 37 and 38, pulleys; 39, 40, 41 and 42, bearings; 43, 44, 45, 46 and 47, shaft couplings, such as chain couplings; 48 and 49, worm speed reducing devices; 50 and 51, intermediate gearings; 52, 53, 54, 55, 56, 57 and 58, shaft couplings, such as universal joints; 59, 60, 61, 62, 63, 64 and 65, stands; 66, 67, 68, 69, 70, 71 and 72, roll shafts; and 73 and 74, beds. The bed 74 has secured thereto the bearings 39, 40, 41 and 42, worm speed reducing devices 48 and 49, and intermediate gearings 50 and 51 which are located in regular positions. The power delivered to the pulley 38 is transmitted through the shaft couplings 43, 44, 45, 46 and 47 and smoothly delivered to the shaft couplings, such as universal joints. The stands 59–60 are secured to the bed 73 in predetermined spaced relation and the roll shafts 66–72 are mounted on the stands so that the former may smoothly rotate. Shaping rolls of a desired shape are mounted on the roll shafts of each stand and journalled by built-in bearings so as to bear a thrust load and a radial load which will be applied during the roll forming of strip. Power is transmitted from the electric motor 35 through the pulley 37, V-belts 75, pulley 38, shafts 76 and 77 supporting the pulley 38, chain couplings 43–45, worm speed reducing devices 48, 49, chain couplings 46, 47, intermediate gearings 50, 51, and universal joints 52–58 to the roll shafts 66–72, so as to effect roll forming of strip. The intermediate gearings 50 and 51 have built therein a device for connecting gears to the universal joints and other shaft couplings for driving the upper and lower roll shafts. The apparatus shown in FIG. 8 is of the universal joint system wherein one intermediate gearing 50 includes a drive source for four sets of roll shafts, and the other intermediate gearing 51 includes a drive source for three sets of roll shafts. However, the invention is not limited to this specific form of intermediate gearings and drive sources for roll shafts can be freely selected by taking into consideration strength and cost of the intermediate gearings. The stands 59–65 are spaced apart from each other an equal distance 78. The minimum spacing between the adjacent stands is determined by the length 79 of the stand frame. It will be appreciated that the spacing between the stands is greatly reduced in the apparatus shown in FIG. 8 as compared with the corresponding spacing in cold forming roll apparatus of the prior art. Coupling means for connecting the gears of the intermediate gearings 50 and 51 to the universal joints 52–58 for driving the upper and lower roll shafts can be spaced apart a distance 78' which may match the spacing 78 between the stands or may be selected in any way desired, because the gearing uses a plurality of gears in combination.

FIG. 9 shows another form of cold forming roll apparatus in which the spacing between the stands can also be reduced. In this form of apparatus, intermediate shafts are used in place of the intermediate gearings. Power is transmitted from an electric motor 80 to an intermediate shaft pulley 83 by way of a speed reducing device 81 and a pulley 82. The pulley 83 drives two intermediate shafts 89 and 90 connected together in a straight line by a shaft coupling (chain coupling) 91. Bearings 84, 85, 86, 87 and 88 are arranged on a bed 34 in suitable position of the elongated intermediate shafts to ensure that the power rotates the shafts in a normal manner. Mounted on the intermediate shafts are pulleys 92, 93, 94, 95, 96, 97 and 98 which transmit power through belts (or chains) 99, 100, 101, 102, 103, 104 and 105 to pulleys 92', 93', 94', 95', 96', 97' and 98' of small worm speed reducing devices of the stands each including a pair of rolls. The power is transmitted to universal joints 113, 114, 115, 116, 117, 118 and 119 by changing the direction through 90 degrees by the worm speed reducing devices 106, 107, 108, 109, 110, 111 and 112. From the universal joints 113–119, the power is delivered to roll shafts 127, 128, 129, 130, 131, 132 and 133 of roll stands 120, 121, 122, 123, 124, 125 and 126 respectively to drive the same. Suitable shaping rolls are mounted on the roll shafts and bearings are built-in the stands for bearing a thrust load and a radial load applied when a cold roll forming operation is performed. The shaping rolls of the stands differ from each other in shape for successively roll forming strip through successive roll stands to impart a desired shape to the product in the final stand.

The cold roll forming apparatus shown in FIGS. 8 and 9 are characterized in having intermediate gearings and intermediate shafts respectively which are interposed between the power source and the roll stands, so that power can be divided and delivered to each roll stand. In the form of apparatus shown in FIG. 9, the worm speed reducing devices can have their size reduced, and the spacings G, H, I, J, K and L can be reduced. The apparatus offers the advantages that cold roll forming ability can be greatly increased as compared with the corresponding ability of apparatus of the prior art, and that particularly the longitudinal curvature of the edge portions of a cold roll formed shape strip of a special cross sectional shape which is curved longitudinally can be reduced. In the forms of apparatus shown in FIGS. 8 and 9, the spacing between the roll stands can be reduced by 50 to 60% of the spacing between the roll stands of a conventional cold forming roll apparatus.

When a product having a high rise of the section of the shaped product relative to the thickness of the material or a product curved longitudinally with a predetermined amount of curvature in such a manner that the edge portions of the product are on the concave side of the curvature and the web of the product is on the convex side of the curvature is produced by cold roll forming, the rise and curved portions of the strip have hitherto been tended to be pressed more strongly on one surface thereof than on the other surface so that one surface is given with greater elongation than the outer surface. As a result, the product has its quality greatly reduced because the buckling strength of the strip is reduced and edge waves are formed in the product manifecting buckling. Particularly when the product is a curved product having a predetermined amount of curvature longitudinally of the product and its lips are disposed on the inner side of the curvature, difficulties have hitherto been experienced in shaping the strip in a manner to impart a desired curvature to the product, in case the strip has no sufficient buckling strength. To cope with this situation, the invention provides a plurality of units of idle rolls arranged longitudinally between the cold forming roll stands in part of the first step and the second step where buckling occurs oftenest, so as to support the edge of strip at both surfaces thereof by the idle rolls of one unit on either side of the strip. By this arrangement, it is possible to reduce the curving of the edge portions of the product longitudinally thereof by maintaining balance in strain produced by roll forming and preventing buckling.

Figure 10:
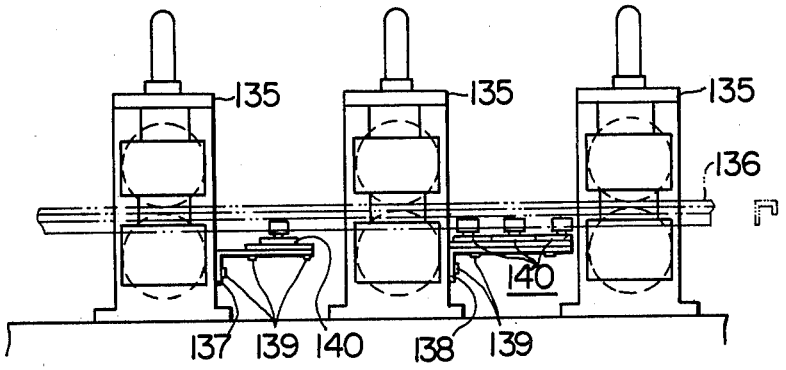
FIG. 10 is a schematic front view of a cold forming roll apparatus effecting roll forming of metal strip by supporting edge portions thereof at opposite surfaces thereof according to the method of the invention.
Figure 11:
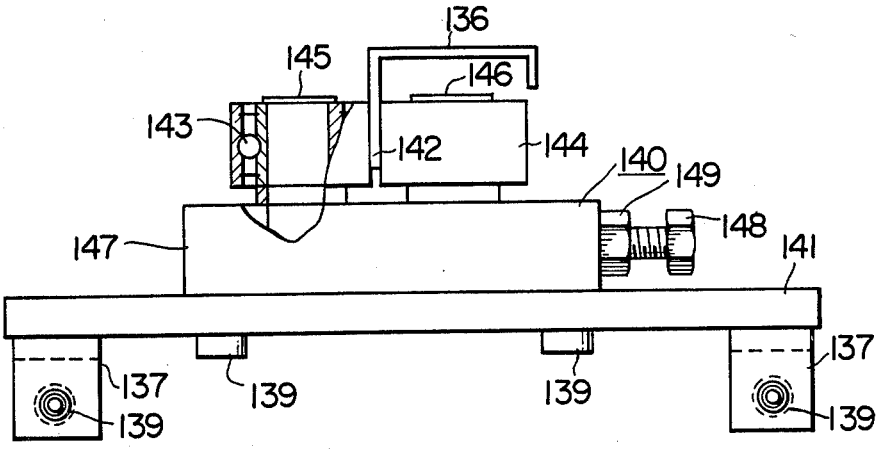
FIG. 11 is a fragmentary view, on an enlarged scale, of FIG. 10, showing an idling roll device partly in section.

FIG. 10 is a schematic front view of one form of cold forming roll apparatus wherein idle roll means for supporting the edges of strip on opposite surfaces thereof is mounted between the cold forming roll stands, and FIG. 11 shows, in fragmentary sectional view, the idle roll means. The shaping rolls mounted in each stand 135 are driven by power delivered from the drive of the cold forming roll apparatus to impart a desired shape to a strip 136. Brackets 137 and 138 are secured by bolts 139 to the stands 135 in predetermined positions. An idle roll unit 140 including a mounting plate 147, shafts 145 and 146, idle rolls 143 and 144, bearings, bolts 148 and nuts 149 is secured to the brackets 137 or 138 by the bolts 139 through a frame 141. The idle rolls 143 and 144 support opposite surfaces of one edge of the strip 136 to shape the strip continuously.

Figure 12A:
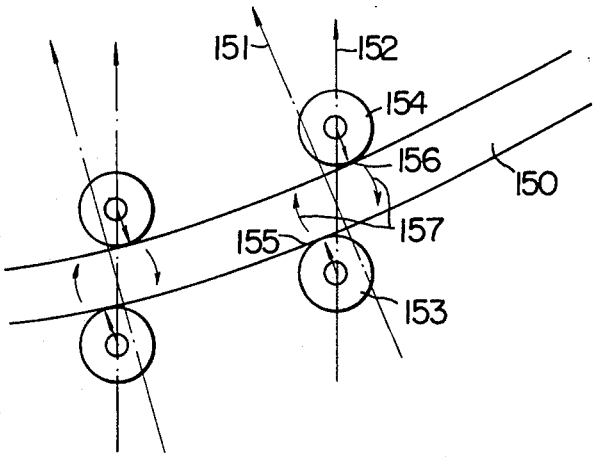
FIG. 12A PRIOR ART
FIG. 12A is a view in explanation of the manner in which roll forming of metal strip is effected by a conventional cold forming roll apparatus.

According to the invention, the confronting roll shafts of cold forming roll stands for carrying out at least part of the second step of curving the roll formed product longitudinally thereof are disposed so that an extension of the line connecting together the center axes of the confronting roll shafts will pass through the center of the radius of curvature of the product. By this arrangement, the shaping force exerted by the roll shafts can be oriented in the direction toward the center of the curvature of the product, with a result that the longitudinal curving of the produce can be effected stably and efficiently. In the present invention, the extension of the line connecting together the center axes of the confronting roll shafts need not necessarily be in perfect alignment with the direction toward the center of the curvature of the product. When the recoil characteristic due to the spring back of the curvature of the roll formed product is considered, it is necessary that a distance from an intersecting point of extension of lines connecting together center axes of forming rolls (For example, FIG. 12A, forming rolls 153, 154, 161 and 162.) of two sets adjoined each other to the roll formed product be slightly smaller than the predetermined radius of the curvature of the roll formed product. FIG. 12A shows upper and lower roll shafts of stands wherein a line 151 directed toward the center of curvature of a product 150 is not in alignment with an extension 152 of the line connecting together the upper and lower roll shafts. In this case, the shaping force exerted by rolls 153 and 154 would act vertically on the product 150 at points 155 and 156 of contact between the rolls 153 and 154 and the product 150, with a result that a bending moment 157 would act on the product 150 in a direction opposite to the direction in which the product 150 is to be bent longitudinally thereof. Thus the longitudinally curved product would be recoiled.

Figure 12B:
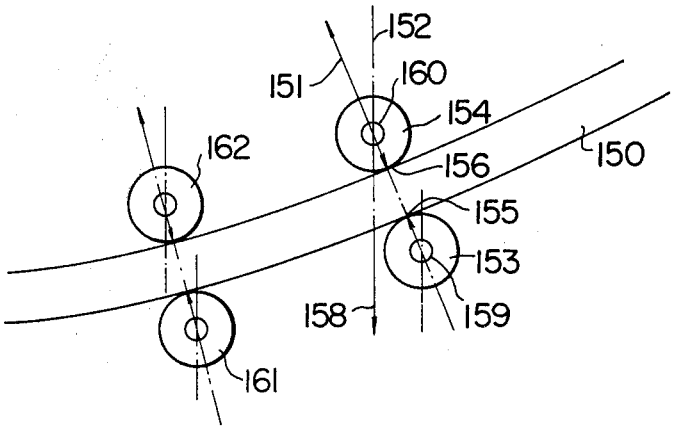
FIG. 12B is a view in explanation of the manner in which roll forming of metal strip is effected by a cold forming roll apparatus according to the invention in which the upper and lower rolls of each roll stand have the center axes of their shafts displaced rightwardly and leftwardly with respect to the perpendicular.

Thus, difficulties are encountered in obtaining a product curved longitudinally a predetermined amount by using the forming roll stands shown in FIG. 12A. With the roll stands of the prior art, a slight change in the pressure urging the upper and lower rolls together to shape the product or in the thickness of the product has tended to change greatly the aforesaid bending moment which is opposite to the direction of curving of the product so that great difficulties have been experienced in imparting a desired curvature to the product to obtain a product of controlled quality. FIG. 12B shows the arrangement of the roll stands according to the invention which obviates the aforesaid disadvantage of the prior art. As shown, the lower roll shaft 159 is displaced in the direction of movement of the product 150 and the upper roll shaft 160 is displaced in the direction opposite to the direction of movement of the product, with respect to the perpendicular 158 passing through the roll stand. The amount of displacement of each roll shaft is determined by calculation in such a manner that the line connecting together the center axes of the upper and lower roll shafts is in alignment with a line directed toward the center of curvature of the product 150. The line 151 directed toward the center of longitudinal curvature of the product 150 is in alignment with an extension 151 of the line connecting together the center axes of the lower roll shaft 159 and the upper roll shaft 160, and the points 155 and 156 of contact between the rolls 153 and 154 and the product 150 respectively are located on the line 151 directed toward the center of the curvature of the product 150. Thus, a force tending to recoil the longitudinally curved product 150 does not act on the product. Thus, the invention enables a product of a controlled quality in which the radius of longitudinal curvature is stable to be produced.

Further, in order that the radius direction of the curvature of the product may be in alignment with the extension of the line connecting together the center axes of the confronting roll shafts, as shown in FIG. 12B, it is desirable that the confronting roll shafts be disposed eccentrically with respect to the perpendicular of the cold forming roll stand or the cold forming roll stand be inclined, that is, it is preferable that the extension of the line connecting the center of the confronting roll shafts pass through substantially the center of the radius of the curvature of the product without restraining to the direction of the cold forming roll stand.

Figure 13A:
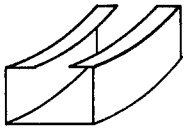
FIG. 13A to FIG. 16C are schematic views of other embodiments according to the method of the invention.
Figure 13B:
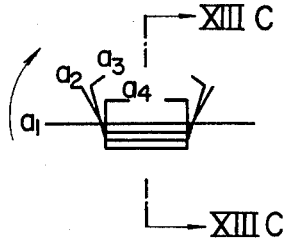
Figure 13C:
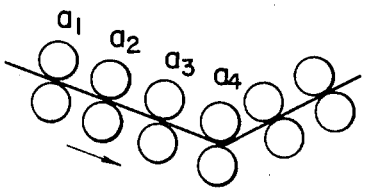
Figure 14A:
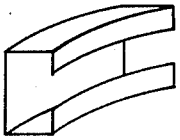
Figure 14B:
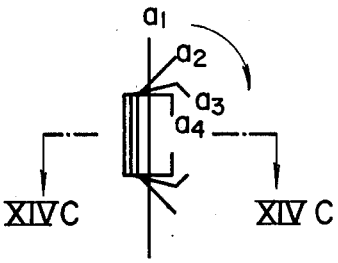
Figure 14C:
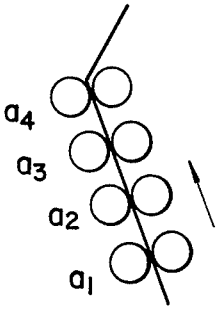
Figure 15A:
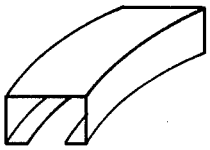
Figure 15B:
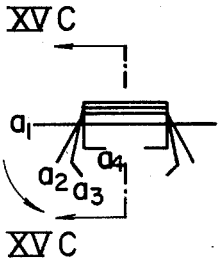
Figure 15C:
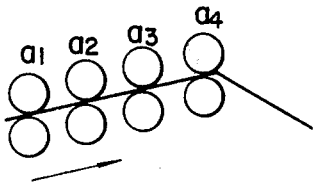
Figure 16A:
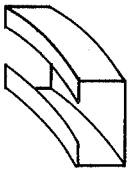
Figure 16B:
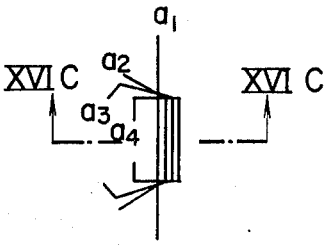
Figure 16C:
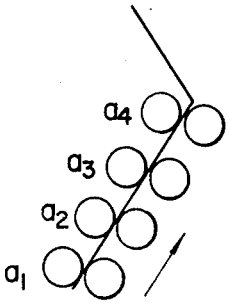

The invention has been shown and described as being applied to cold forming roll apparatus in which uphill and downhill form rolling is effected with upper and lower horizontal shaping rolls. However, it is to be understood that the invention can have application in apparatus wherein uphill and downhill roll forming is effected with vertical rolls leftwardly and rightwardly. FIGS. 3A, 3B, 5, 6A and 6B are sectional schematic views which show forming states of the roll formed products and change of shapes of the metal strip according to the embodiments of the method of the invention. FIGS. 13A, 13B and 13C are schematic views of the cold roll forming step according to the method of the invention and FIG. 13C is schematic views of the cold roll forming step shown from XIIIC—XIIIC direction of FIG. 13B. FIGS. 14A to 14C, 15A to 15C and 16A to 16C are sectional schematic views and schematic views of cold roll forming steps which show forming states of the roll formed products and change of shapes of the metal strip in case of rotations of 90°, 180° and 270° of the roll formed products shown in FIGS. 13A to 13C. In case of the cold roll forming in the forming state of rotation of 180 degree of the roll formed product shown in FIGS. 13A to 13C, the first step becomes the uphill roll forming to effect sectional shape forming and the second step becomes the downhill forming to effect forming of the curvature as shown FIGS. 15A to 15C. The case of vertical forming rolls is shown in FIGS. 14A, 14B, 14C, 16A, 16B and 16C according to embodiments of the method of the invention. That is, in the invention, in order to produce a product longitudinally curved with a predetermined amount of curvature in such a manner that its edge portions are on the concave side of the curvature and its web is on the convex side thereof, shaping step is carried out, together with changing the height of the point of contact between metal strip to be roll formed and the rolls of each cold forming roll stand so as to inhibit elongation deformation of marginal portions of strip which constitute the edges of the curved product, and curving step is carried out to curve the roll formed product longitudinally thereof with a predetermined curvature in such a manner that its edge portions are on the concave side of the curvature and its web is on the convex side thereof, together with changing gradually the height of the point of contact between roll formed product and the rolls of each cold forming roll stand in the reverse direction to the shaping steel, and roll forming being effected simultaneously from multiple directions at least as part of the curving step. The direction in which the roll formed product and the shaping rolls are directed and other factor have nothing to do with the essentials of the invention. Further, the present invention, may include a step wherein the metal strip is ground and washed previously, then shaping step is carried out, while advancing the metal strip, together with changing gradually the height of the point of contact between the metal strip to be roll formed and the rolls of each cold forming roll stand so as to inhibit elongation deformation of portions of the metal strip which constitutes the edge portions of the roll formed shape strip and then curving step is carried out to curve the roll formed product longitudinally thereof with the predetermined curvature in such a manner that its edge portions are on the concave side of the curvature and its web is on the convex side thereof, together with changing gradually the height of the point of contact between the roll formed product and the rolls of each cold forming roll stand in the reverse direction to the shaping step, and roll forming is carried out simultaneously from multiple directions at least as part of the curving step and later, the roll formed product is cut to a predetermined length and the like. The invention has been shown and described largely by referring to a channel shape strip having lips. However, it will be understood that the invention can be applied in producing any shape strip, regardless of whether the shape strip has lips or not.

According to the present invention, steel strip, 55 $Kg/mm^2$ high-tensile steel (Trade name, APFC 55) was shaped by thirteen stands of cold forming roll stands as the first step, then was curved longitudinally thereof by two stands of cold forming roll stands as the second step, and the above roll formed products were formed by a total of fifteen stands of cold forming roll stands and radius of curvature of the roll formed products having a radius of curvature 3 meter to 10 meter, so that the present invention was formed over a broad range to accommodate all demands for bumpers of current automotive vehicles.

From the foregoing description, it will be appreciated that the method of cold roll forming according to the invention makes it possible to produce shape strip of high quality free from galling, edge waves, buckling and deformation and having a reduced longitudinal curvature in the edge portions of the product, with a high degree of efficiency and in a stable manner. The invention enables the production of a product having a predetermined radius of curvature by roll forming strip of a smaller thickness than has ever been used in the prior art.

What is claimed is:

1. A method of cold roll forming an automotive vehicle bumper comprising:

grinding and washing a metal strip;

forming said metal strip into a shaped strip, while advancing the metal strip, together with changing gradually the height of a point of contact between metal strip to be formed and rolls of each of a plurality of cold forming roll stands so as to inhibit elongation deformation of marginal portions of the metal strip which constitute the edge portions of a product;

curving said shaped strip longitudinally thereof with a predetermined curvature in such a manner that edge portions of said strip are on a concave side of the curvature and a web portion is on a convex side thereof, together with changing gradually the height of the point of contact between said roll formed shaped strip and rolls of each cold forming roll stand in a reverse direction to the forming step and disposing said rolls of each cold forming roll stand for carrying out at least part of said second step for curving the product longitudinally so as to be passed through substantially an extension of a line connecting together the center axes of the shafts of said confronting rolls to a center of the curvature of the product so that the shaping force may be directed toward the center of the curvature of the product when cold roll forming is effected, while simultaneously effecting roll forming from multiple directions at least as part of the curving step; and the roll formed product being cut to a predetermined length.

2. A method of cold roll forming, wherein a metal strip is passed through a plurality of cold forming roll stands to effect cold roll forming of the strip to produce successively a shape strip which is curved longitudinally with a predetermined amount of curvature in such a manner that edge portions of said strip are on a concave side of the curvature and a web portion is on a convex side thereof, comprising:

a first step of subjecting said metal strip, while advancing the metal strip to a gradual change of the height of a point of contact between metal strip to be formed and rolls of each cold-forming roll stand so as to inhibit elongation deformation of marginal portions of the metal strip which constitutes the edge portions of a product;

a second step of subjecting the product to roll forming to curve the product longitudinally thereof with a predetermined curvature in such a manner that its edge portions are on the concave side of said curvature and its web is on the convex side thereof, changing gradually the height of a point of contact between roll formed shape strip and rolls of each cold-forming roll stand in a reverse direction to the first step and disposing confronting rolls of each cold-forming roll stand for carrying out at least part of said second step for curving the product longitudinally so that said product is passed through substantially an extension of the line connecting together the center axes of the shafts of said confronting rolls to the center of the curvature of the product, thereby the shaping force may be directed toward the center of the curvature of the product when cold roll forming is effected, while simultaneously effecting roll forming from multiple directions at least as part of the second step.

3. A method of cold roll forming as set forth in claim 2, wherein is included the step of imparting, before the second step is carried out, elongation deformation to a portion of the metal strip which constitutes the web of the product is carried out as part of the first step.

4. A method of cold roll forming as set forth in claim 2 or 3, wherein simultaneous roll forming of the metal strip from multiple directions is carried out at least as part of the first step.

5. A method of cold roll forming as set forth in claim 2, wherein cold roll forming is effected by reducing the spacing between cold forming roll stands from the ground in the first step and/or the second step without reducing the shaping ability of cold forming roll apparatus.

6. A method of cold roll forming as set forth in claim 2, wherein a plurality of units of idle rolls are arranged between cold forming roll stands arbitrarily selected from the cold forming roll stands for carrying out the first step and the second step, the idle rolls of each unit being in longitudinally spaced juxtaposed relation for supporting one of two edge portions of the metal strip at opposite surfaces thereof, to effect roll forming of the metal strip which passes through the idle rolls of plurality of pairs.

7. A method of cold roll forming as set forth in claim 4, wherein simultaneous shaping applied to the first step and/or the second step from multiple directions is simultaneous shaping from both vertical and horizontal directions.

8. A method of cold roll forming as set forth in claim 2, wherein a roll formed shape strip constitutes bumpers for automotive vehicles.

9. For use with groups of cold roll forming stands, confronting rolls of successive stands of each group being disposed with respect to a bed at heights which successively differ incrementally in one of a first and second senses, a method of cold roll forming a metal strip to produce a product which is curved longitudinally with a predetermined amount of curvature in such a manner that edge portions of said strip are on a concave side of the curvature and a web portion is on a convex side thereof, comprising:

inhibiting elongation deformation of marginal portions of said metal strip which constitutes the edge portions of said product by advancing the metal strip to successively engage rolls of a first group of cold roll forming stands having said heights differing in said first sense, curving the metal strip longitudinally by advancing the metal strip to successively engage rolls of a second group of cold roll forming stands having said heights differing in said second sense.

10. A method of cold roll forming a metal strip as set forth in claim 9, wherein said curving step further comprises:

passing said metal strip through a straight line connecting the center of longitudinal curvature of said product and the axes of confronting rolls of at least one cold roll forming stand.

11. A method of cold roll forming a metal strip as set forth in claim 10, further comprising the step of:

effecting roll forming from multiple directions simultaneously with at least part of said curving step.

12. A method of cold roll forming a metal strip as set forth in claim 11, wherein said step of effecting roll forming from multiple directions further comprises effecting roll forming in at least one direction with rolls rotating independently with respect to the rolls effecting roll forming in the remainder of said multiple directions.

13. A method of cold roll forming as set forth in claim 9, further comprising:

compensating spring back of the curvature of said product by passing said metal strip between confronting rolls of at least two cold roll forming stands, the axes of the confronting rolls being disposed such that substantially straight lines passing through the axes of confronting rolls of said at least two cold roll forming stands intersect at a point which is distant from said stands by a distance less than the radius of longitudinal curvature of said product.

14. A system for reducing the longitudinal radius of curvature of a product which is cold roll formed from a metal strip, by reducing the distance between a first plurality of cold roll stands comprising a power source, power train means for supplying power from said power source, first worm gear reduction means for receiving the output of said power train means, and a first plurality of cold roll stand means for receiving power directly from said worm gear reduction means, each of said cold roll stand means comprising a plurality of cold roll stands, at least a second worm gear reduction means receiving power from said first worm gear reduction means, a third plurality of intermediate reduction gear means for accepting power from said second worm gear reduction means, and means for individually providing power to each of said cold roll stands from respective individual intermediate reduction gear means of said third plurality, whereby the distance between individual cold roll stands is reduced resulting in reduction of said longitudinal radius of curvature.

15. A system for reducing the longitudinal radius of curvature of a product, which is cold roll formed from a metal strip, by reducing the distance between a first plurality of cold roll stands comprising a power source, power train means for supplying power from said power source, first worm gear reduction means for receiving the output of said power train means, and a first plurality of cold roll stand means for receiving power directly from said worm gear reduction means, each of said cold roll stand means comprising a plurality of cold roll stands, wherein at least one of said cold roll forming stands forms a product having a longitudinal radius of curvature terminating at a center of curvature and comprises confronting rolls each having an axis of rotation disposed so that a substantially straight line passes through said center of curvature and through each of said axes of rotation of said confronting rolls, whereby the distance between individual cold roll stands is reduced resulting in reduction of said longitudinal radius of curvature.

16. A system for reducing the longitudinal radius of curvature of a product, which is cold roll formed from a metal strip, by reducing the distance between a first plurality of cold roll stands comprising a power source, power train means for supplying power from said power source, first worm gear reduction means for receiving the output of said power train means, and a first plurality of cold roll stand means for receiving power directly from said worm gear reduction means, each of said cold roll stand means comprising a plurality of cold roll stands, at least a second worm gear reduction means receiving power from said first worm gear reduction means, a third plurality of intermediate reduction gear means for accepting power from said second worm gear reduction means, and means for individually providing power to each of said cold roll stands from respective individual intermediate reduction gear means of said third plurality, wherein at least one of said cold roll forming stands forms a product having a longitudinal radius of curvature terminating at a center of curvature and comprises confronting rolls each having an axis of rotation disposed so that a substantially straight line passes through said center of curvature and through each of said axes of rotation of said confronting rolls, whereby the distance between cold roll stands is reduced resulting in reduction of said longitudinal radius of curvature.

17. A system for reducing the longitudinal radius of curvature of a product, which is cold roll formed from a metal strip, by reducing the distance between a first plurality of cold roll stands comprising a power source, power train means for supplying power from said power source, first worm gear reduction means for receiving the output of said power train means, and a first plurality of cold roll stand means for receiving power directly from said worm gear reduction means, each of said cold roll stand means comprising a plurality of cold roll stands, wherein said first worm gear reduction means includes, a plurality of individual second worm gear assemblies, and means for individually providing power to each of said cold roll stands from respective individual second worm gear assemblies, wherein at least one of said cold roll forming stands forms a product having a longitudinal radius of curvature terminating at a center of curvature and comprises confronting rolls each having an axis of rotation disposed so that a substantially straight line passes through said center of curvature and through each of said axes of rotation of said confronting rolls, whereby the distance between cold roll stands is reduced resulting in reduction of said longitudinal radius of curvature.

* * * * *